US005917534A

United States Patent [19]

Rajeswaran

[11] Patent Number: 5,917,534

[45] Date of Patent: Jun. 29, 1999

[54] LIGHT-EMITTING DIODE ARRAYS WITH INTEGRATED PHOTODETECTORS FORMED AS A MONOLITHIC DEVICE AND METHODS AND APPARATUS FOR USING SAME

[75] Inventor: Gopalan Rajeswaran, Fairport, N.Y.

[73] Assignee: Eastman Kodak Company, N.Y.

[21] Appl. No.: 08/624,033

[22] Filed: Mar. 27, 1996

Related U.S. Application Data

[XX .
[60] Provisional application No. 60/000,662, Jun. 29, 1995.

[51] Int. Cl.[6] ..... B41J 2/45; B41J 2/47; B41J 2/435

[52] U.S. Cl. ..... 347/238; 347/236

[58] Field of Search ..... 347/238, 236, 347/133; 257/88; 258/578, 208.1

[56] References Cited

U.S. PATENT DOCUMENTS 4,588,883 5/1986 Abbas .
4,750,010 6/1988 Ayers et al. .
4,780,731 10/1988 Creutzmann et al. .
4,998,118 3/1991 Ng .
5,135,877 8/1992 Albergo et al. .
5,253,934 10/1993 Potucek et al. .
5,300,960 4/1994 Pham et al. .
5,389,953 2/1995 Agar et al. .

FOREIGN PATENT DOCUMENTS 5-327009 12/1993 Japan ..... 257/88

*Primary Examiner*—N. Le
*Assistant Examiner*—Thinh Nguyen
*Attorney, Agent, or Firm*—Norman Rushefsky

[57] ABSTRACT

A monolithic device comprises an LED chip array that includes photodetectors formed on the device so that each photodetector is associated with a respective LED for detecting light output of the LED. The locations of the photodetectors and the respective rows of bond pads for the LEDs and photodetectors are such as to facilitate connection to associated current driver circuitry. The device is preferably used on an LED printhead. Methods and apparatus are provided for using the device in recording of images. Printheads using such devices allow for determinations of improper operation of the LEDs either in real time or during other times such as interframe per rods. Thus, LED malfunction may be caught promptly without need to stop production to allow a diagnostic photodetector to traverse over the LEDs.

30 Claims, 13 Drawing Sheets

LIGHT-EMITTING DIODE ARRAYS WITH INTEGRATED PHOTODETECTORS FORMED AS A MONOLITHIC DEVICE AND METHODS AND APPARATUS FOR USING SAME

CROSS REFERENCE TO RELATED APPLICATION

Reference is made to and priority claimed from U.S. Provisional Application Ser. No. 60/000,662 filed Jun. 29, 1995, entitled LIGHT-EMITTING DIODE ARRAYS WITH INTEGRATED PHOTODETECTORS FORMED AS A MONOLITHIC DEVICE AND METHODS AND APPARATUS FOR USING SAME.

BACKGROUND OF THE INVENTION

1. Field of the Invention

The present invention relates to arrays of light-emitting elements on monolithic devices and more particularly to such arrays that incorporate as part of the monolithic device a light sensor for sensing output from the elements.

2. Description of the Prior Art

The term "monolithic device" as used herein refers to a device that is formed on a single semiconductor crystal chip array. Light-emitting diode (LED) chip arrays are well known in the prior art and are typically used in printheads for electrophotographic copiers or the like. For example, see U.S. Pat. No. 5,253,934, the contents of which are incorporated by this reference. Such a printhead array comprises a row of uniformly spaced LED light sources that can be individually energized to generate light to expose a photoreceptor or other image receiving medium to produce an image pattern. A typical LED printhead for this type for standard DIN A4 paper dimensions would be about 216 millimeters long and the individual light sources are very small and very closely spaced, e.g., as many as 400 or more sites per linear inch (15.75 sites per mm). A complete printhead comprises a number of individual LED chip arrays, each being typically less than 10 millimeters long, which are mounted in endwise relation to one another in forming of the full length printhead.

High-density, linear LED chip arrays can be fabricated as a monolithic device to be used as light sources in electronic printing application. With existing technology, it is possible to fabricate an array of light-emitting diodes on a single gallium arsenide chip which, without further correction, is adequate for two-level exposure. A two-level exposure is produced when an LED can selectively be turned on or off. LED chip arrays with a large number of exposure levels are required for good quality, continuous-tone images. At any given exposure level, any one of the LEDs should produce light with an intensity that is within an acceptable range. For example, the light intensity of a diode at a given exposure level may be required to be within a few tenths of a percent of the light intensity at the same exposure level of any other array light-emitting diode on the printhead. If such is not the case, undesirable bands may appear in the output image.

The output image intensity of LEDs fabricated in a monolithic device and driven at constant current degrades nonuniformly with usage. In order to prevent undesirable bands, it is necessary to provide dynamic correction, i.e., the output light intensity at each exposure level of each LED of a chip array must be periodically measured and corrected so that across the entire array, each exposure level is within the proper intensity range.

In order to provide this dynamic correction, it is known from U.S. Pat. No. 4,588,883, filed in the name of Abbas, to incorporate on the monolithic device a photodetector that can sense subsurface light generated by each LED which subsurface light is related to that emitted by the LED. The Abbas patent describes a single, wide, monolithic photodetector fabricated along one length of the LED arrays. In practice, high density (≧400 dpi) LED printheads containing LED arrays have wirebonds from the control electronics (Driver ICs) accessing the LED arrays from both sides. This results in addressing the odd/even LED channels of each LED chip from opposite ends. To implement Abbas' invention in such dual-sided addressed LED writers would require an additional process step during the LED wafer fabrication, to run LED electrode/bond pad metallization traces over the photodetector towards the Driver IC wirebonds.

It is therefore an object of the invention to eliminate this extra process step by yet providing a monolithic device having an array of photodetector devices in already available real estate on the LED chip surface.

SUMMARY OF THE INVENTION

In accordance with the invention there is provided a monolithic device and methods and apparatus using same, the device comprising: (a) a semiconductor substrate; (b) an array of plural light-emitting elements fabricated in the substrate, the elements being arranged in a row; (c) a set of respective photodetectors fabricated in the substrate adjacent each respective light-emitting element for sensing subsurface light of a respective element.

The invention is further directed to apparatus and methods for use of the monolithic device for diagnosing error or malfunction of a light-emitting element on the device or to providing adjustments to control exposure by said element.

BRIEF DESCRIPTION OF THE DRAWINGS

The invention will be described further by way of preferred examples, with reference to the drawings wherein.

DESCRIPTION OF THE ILLUSTRATIVE PREFERRED EMBODIMENTS

Because LED arrays in general and printer apparatus for using LED arrays are well known, the present description will be directed in particular to elements forming part of or cooperating more directly with the present invention. In the detailed description provided below, reference will be made to the accompanying drawings.

Figure 1:
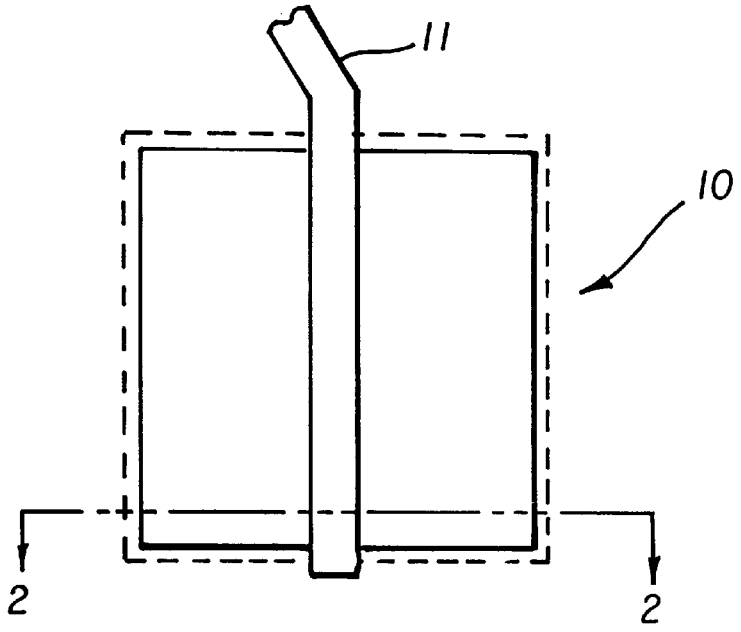
FIG. 1 (prior art)
FIG. 1 is a schematic of a plan view of one LED Gallium Arsenide Phosphide/Gallium Arsenide (GaAsP/GaAs) light-emitting diode as known in the prior art.
Figure 2:
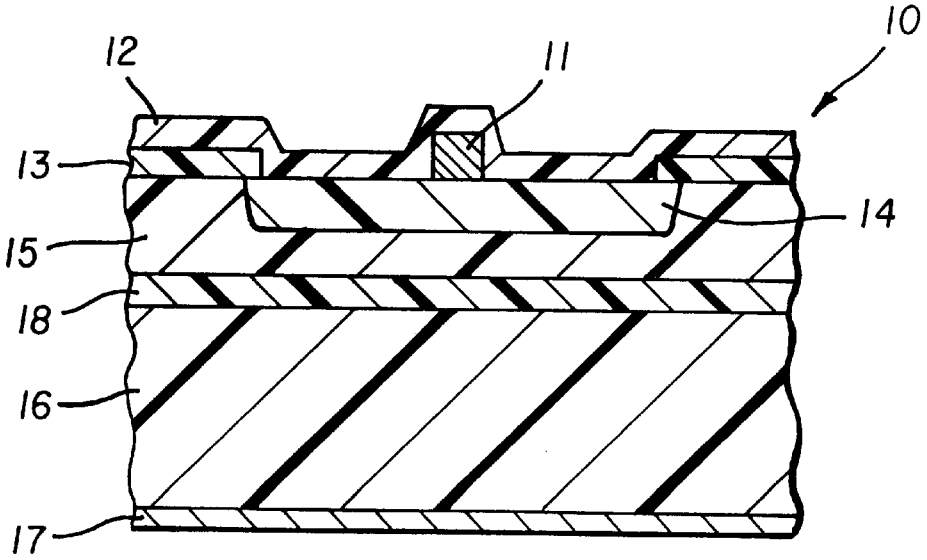
FIG. 2 (prior art)
FIG. 2 is a sectional view taken on the line 2—2 of the LED of FIG. 1.

The light sources employed in common LED writing systems are typically homojunction light-emitting diodes (LEDs) based on Gallium Arsenide Phosphide/Gallium Arsenide alloy materials. FIGS. 1 and 2 show the device structure of a common GaAsP/GaAs light-emitting diode 10. An n-type GaAsP alloy layer or layers 15, 18 is grown on an n-type GaAs substrate 16 by vapor phase epitaxy. In order to minimize dislocation defects caused by lattice mismatch between the GaAs substrate and the final desired composition of the GaAsP epitaxial layer 15, an intermediate n-GaAsP graded layer 18 is grown as shown. The resulting combined epitaxial layer 15, 18 ranges in thickness from 25 to 100 $\mu$m across the GaAs substrate wafer. Using common semiconductor fabrication techniques, a thin diffusion barrier layer of silicon nitride (SiN) is deposited on the epitaxial layer surface 13. This SiN layer is patterned by photolithography to open windows for diffusion. A p-type layer 14 is formed in the GaAsP epitaxial layer through the window openings by closed tube or open tube diffusion techniques commonly employing zinc as the doping material. Further wafer processing results in ohmic electrode contacts (as shown in FIG. 1) at the pGaAsP and n-GaAs surfaces. The boundary between each such region and the surrounding undoped epitaxial layer material provides a p-n junction at which light is emitted as is well known.

Figure 3:
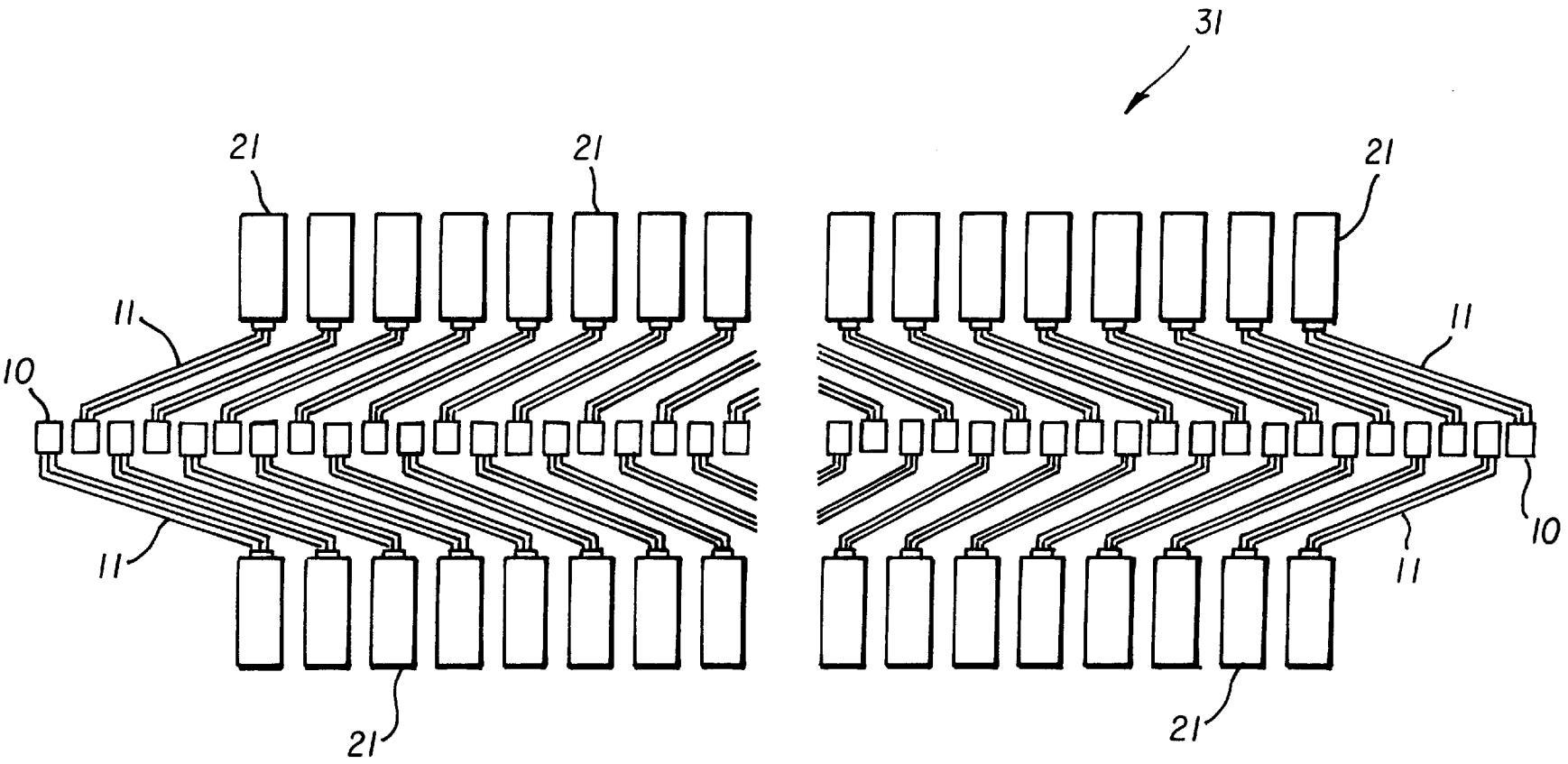
FIG. 3 (prior art)
FIG. 3 shows a schematic of a known typical layout of a chip array of LEDs used in printhead assemblies and as known in the prior art.

The electrode structures 11, typically made of aluminum, are formed on the upper surface of the silicon nitride mask and traverse windows in contact with the upper face of the doped epitaxial layer so that each light-emitting diode can be energized by current flowing between the corresponding electrode structure and the common electrode. An anti-reflection layer 12 of SiN is then formed over the chip array. Details regarding the anti-reflection coating layer and its preferred thickness may be found in U.S. Pat. No. 5,135,877. FIG. 3 shows a typical layout of a chip array 31 of such LEDs used in printhead assemblies.

The foregoing description of the construction of the diode chip array, per se, is simply illustrative and is typical of technology well known in the art, but the present invention is equally applicable to other types of diode array chips.

It should be appreciated that groups of these chip arrays are formed conventionally upon wafers which are then diced to form individual chip arrays of say 128 LEDs on a monolithic device. The chip arrays are then assembled end to end upon a suitable substrate(s) to form a linear array of LEDs to comprise a printhead. In addition to this linear array of LEDs, driver chips are coupled to the bonding pads to provide driving current to LEDs selected for energization in accordance with image data signals fed to the driver chips.

Optical radiation is produced at the p-n junction upon the application of a forward bias voltage. Not all of the radiation, however, will be emitted from the device. For example, in the case of the device shown in FIGS. 1 and 2, radiation provided in areas of the p-n function which underlie the aluminum electrode is typically lost as useful radiation because such areas are obstructed by the opaque (aluminum) electrode.

However, the use of an electrode finger that overlies the window provides greater electrode contact with the p-type region and increases radiant exitance in the central regions of the LED not covered by the electrode.

The illustrative LED diode array chip shown in FIG. 3 is elongate rectangular shape and includes a row of tiny and closely spaced individual light-emitting diodes. Each light-emitting diode, in turn, is energizable by means of a corresponding electrode structure comprising a narrow electrode strip electrically connecting the diode to a wide bonding pad. To allow the bonding pads 21 to be wider than the diodes 10, the electrode structures 11 extend alternately in opposite directions from the successive diodes.

The wavelength of the emission of an LED may be controlled by the concentration of phosphorous in the epitaxial layer. In commercially available printheads, the popular emission wavelengths are 660 nm, 685 nm, 720 nm and 740 nm. Other emission wavelengths matching the response of specific photoconductors in the range from 660 nm to 840 nm are possible with the GaAsP material system. The external quantum efficiency of GaAsP LEDs as shown in FIGS. 1 and 2 is controlled by many factors such as i) zinc diffusion depth, ii) doping concentration of n-GaAsP layer; iii) refractive index and thickness of the anti-reflection coating, iv) shadowing caused by ohmic contact electrode and v) residual concentration of non-radiative recombination centers. In practice, due to internal self-absorption and optical considerations (critical incidence angle for exitance), only about 1% of the photons generated at the junction exits the device. The remaining photons scatter within the epitaxial layer and are finally absorbed by the material. This invention disclosure deals with integrated, monolithic devices that include light-emitting elements and photodetectors that sample this subsurface light and provide a measure of the internal/external quantum efficiencies of the associated light-emitting elements.

Figure 4:
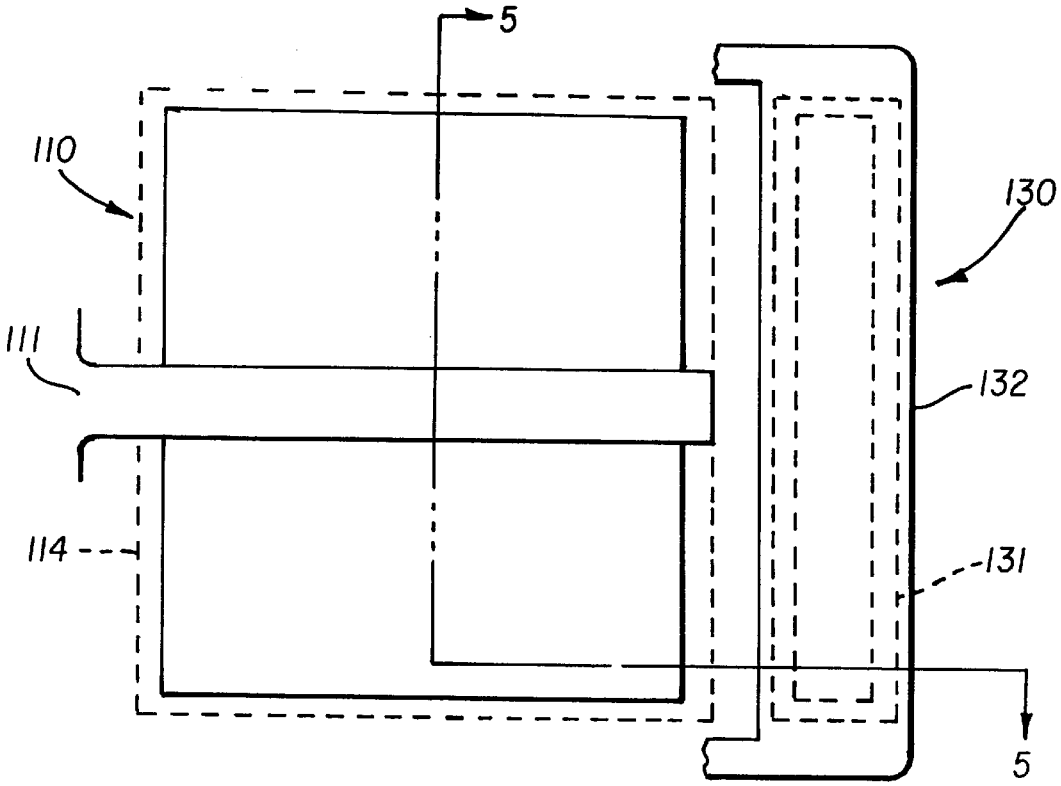
FIG. 4 is a plan view of an LED having an adjacent photodetector forming a part of a monolithic device in accordance with the invention.
Figure 5:
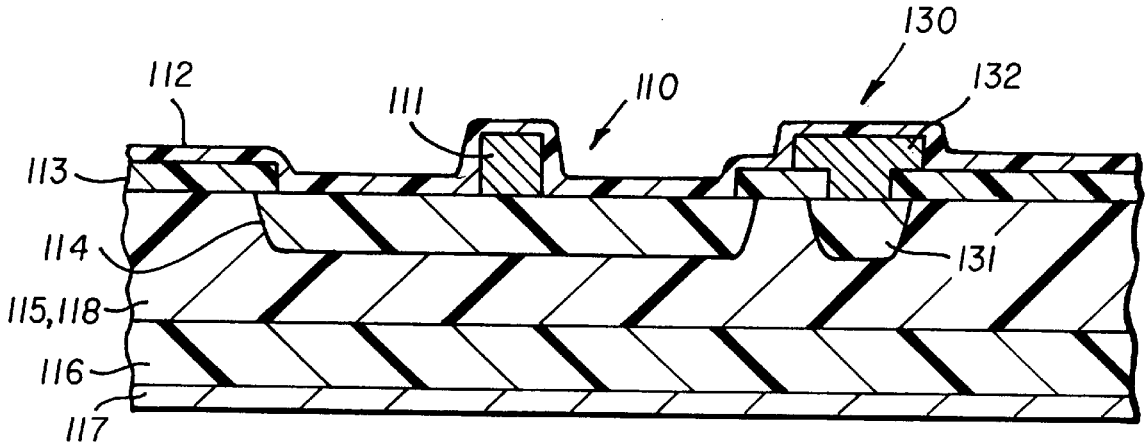
FIG. 5 is a section view taken on the line 5—5 of FIG. 4.
Figure 6:
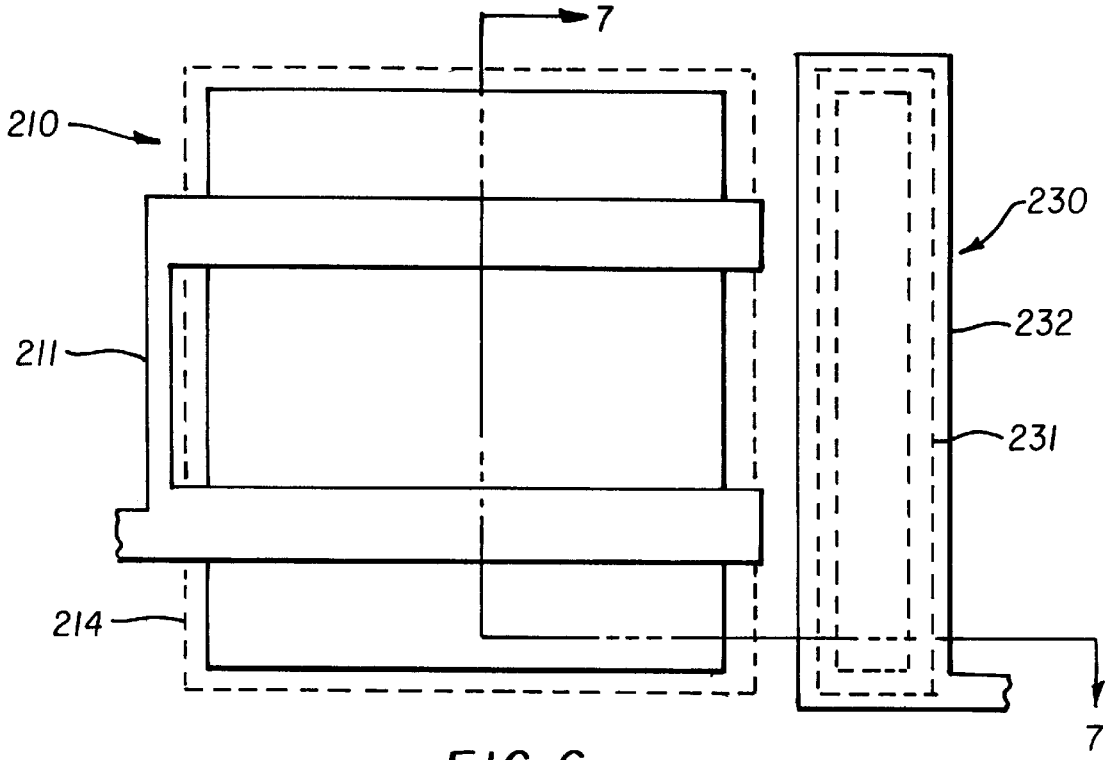
FIG. 6 is a plan view of an LED having an adjacent photodetector forming a part of a monolithic device in accordance with the invention.
Figure 7:
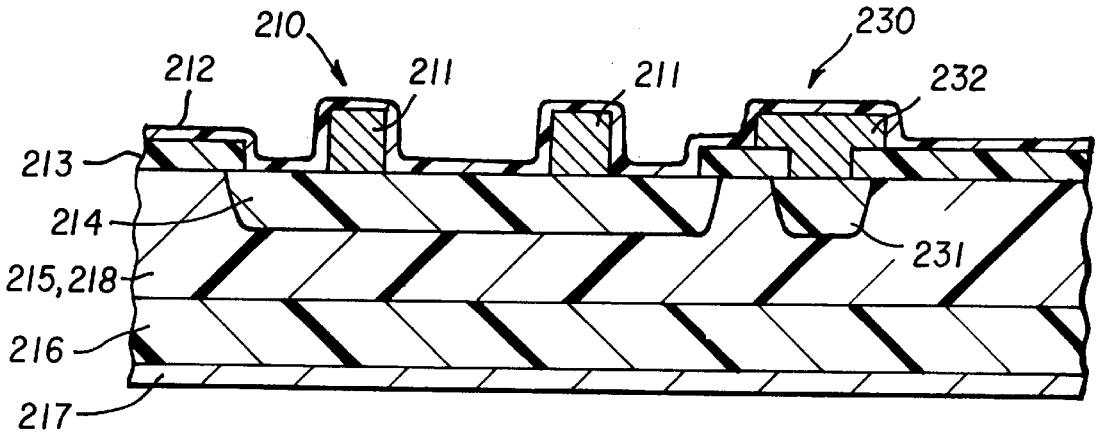
FIG. 7 is a sectional view taken on the line 7—7 of FIG. 6.
Figure 8:
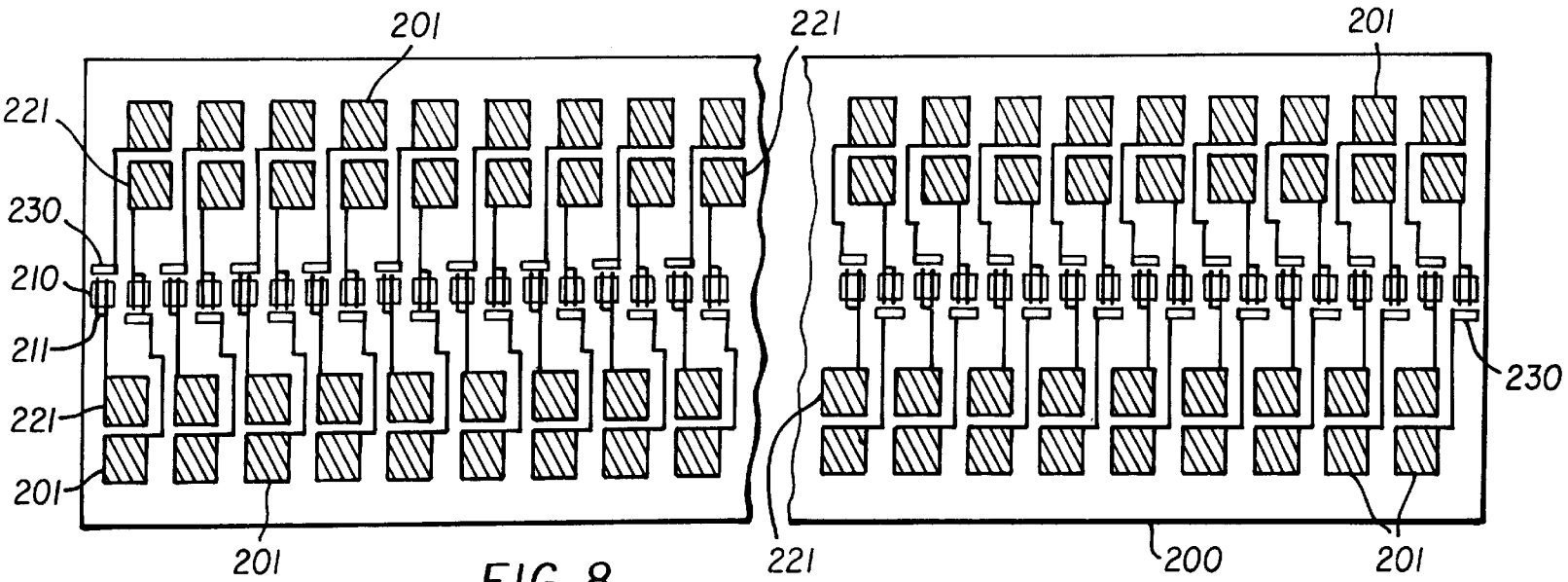
FIG. 8 is a schematic of a layout of an LED array including photodetectors on a monolithic device that is in accordance with one embodiment of the invention.
Figure 9:
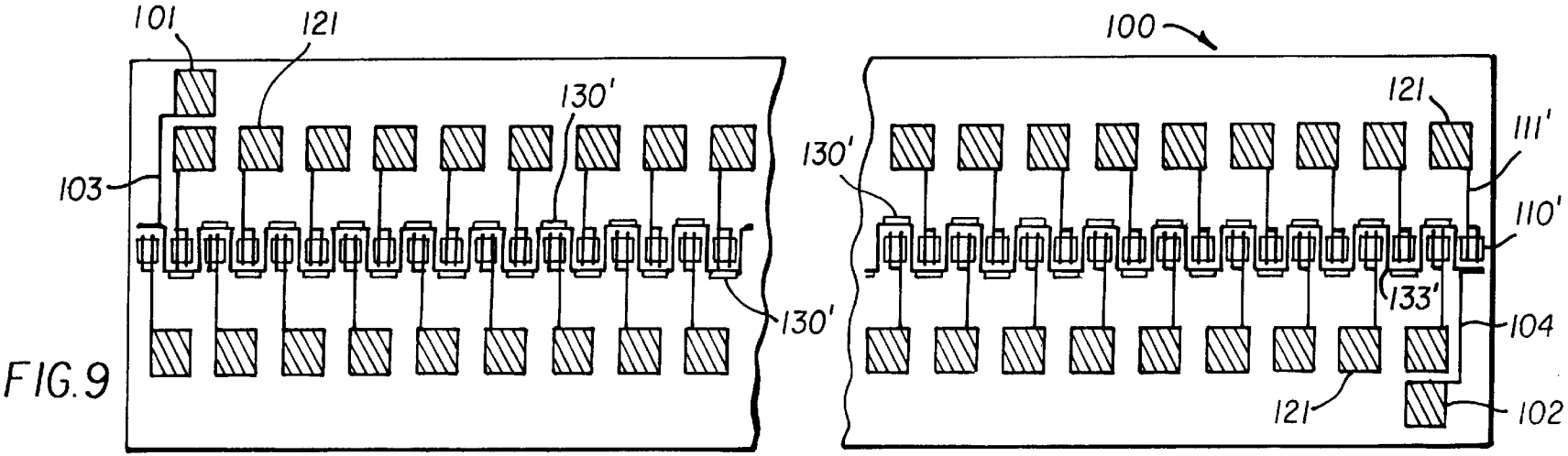
FIG. 9 is a schematic of a layout of an LED array including photodetectors on a monolithic device that is in accordance with a second embodiment of the invention.
Figure 10:
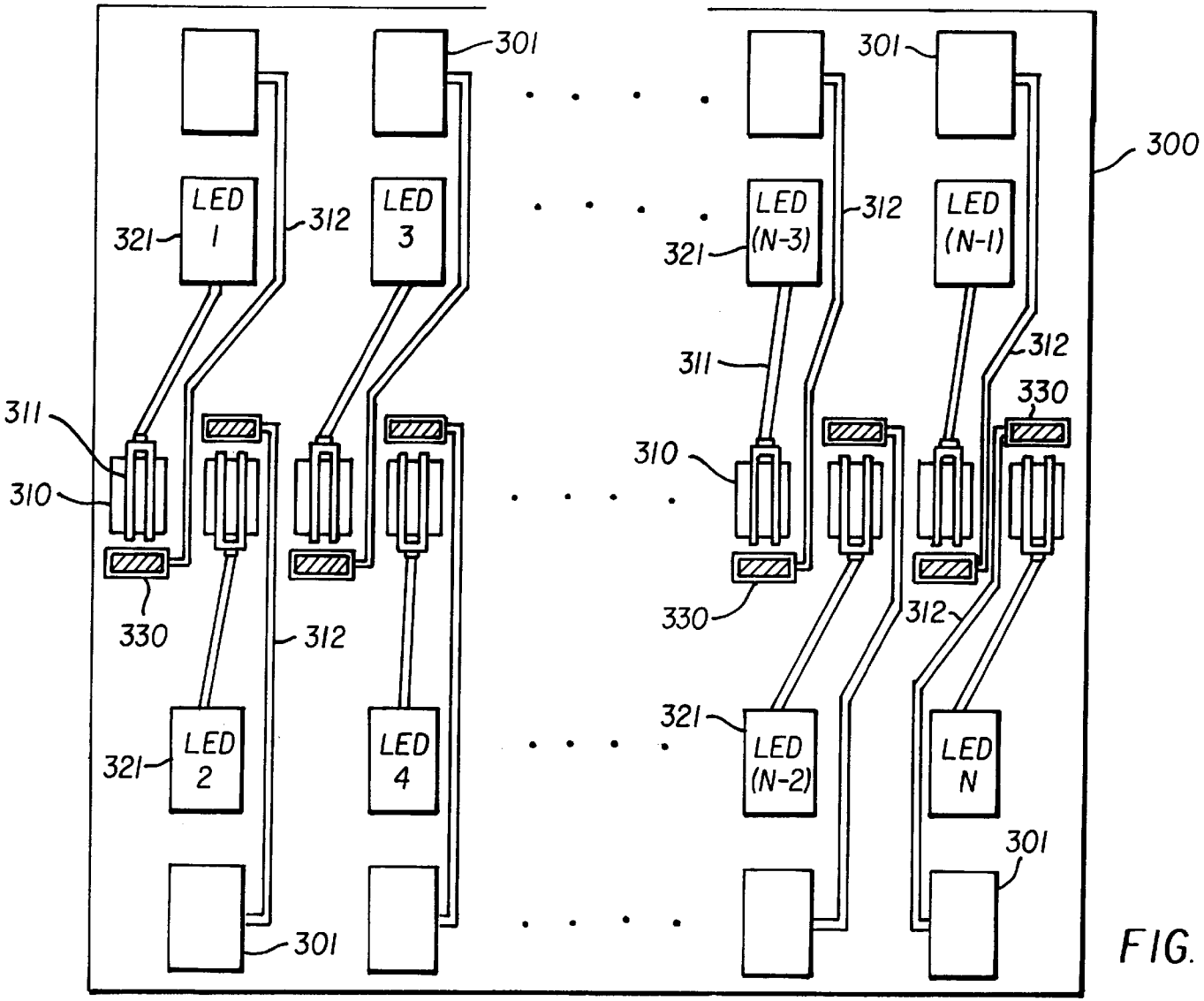
FIG. 10 is a schematic of a layout of some LEDs on an LED array that includes photodetectors on a monolithic device that is in accordance with a third embodiment of the invention.

FIGS. 8, 9 and 10 are three different embodiments of integrated LED/photodetector monolithic devices 200, 100, and 300, respectively that are in accordance with the invention. FIGS. 4 and 5 illustrate an LED on such a device with one electrode while FIGS. 6 and 7 illustrate an LED with two electrodes. With reference to FIGS. 4 and 5 the integrated LED/photodetector device array is fabricated in the same manner as described above but with a different photomask. The photodetector element 130 is actually another LED with metallization 132 covering the diffusion window to prevent external light from impinging on the photodetector p/n junction. The photodetector element is situated in close proximity to the parent LED 110 whose internal quantum efficiency is being monitored. In practice, this distance can be in the 10–50 $\mu$m range. The intensity of subsurface light decreases exponentially as one moves farther from the parent LED. In response to the subsurface light, the photodetector generates a photocurrent signal which is representative of the intensity of the output light emitted from the LED. This behavior is similar to that of a p/n junction solar cell illuminated from its sides. The method of fabrication for the integrated LED/photodetector array is the same as described earlier for the LEDs of FIGS. 1 and 2. Structures in the LED of FIGS. 4 and 5 that correspond to those in the LED of FIGS. 1 and 2 are indicated by similar numerals except that an additional one (1) is placed in front of those identified in the embodiment of FIGS. 4 and 5. Thus, 10 corresponds to 110, 11 corresponds to 111, etc. Similarly, structures in the embodiment of FIGS. 6 and 7 which correspond to structures in FIG. 1 are identified by similar numerals except that an additional two (2) is placed in front of those in the embodiment of FIGS. 6 and 7. The embodiment of FIGS. 6 and 7 differs from the embodiment of FIGS. 4 and 5 in two respects. The first difference is that the electrode 111 of FIGS. 4 and 5 is a single electrode over each LED whereas in the embodiment of FIGS. 6 and 7 the electrode is a bifurcated structure. This difference is not significant from the point of view of the invention herein but does affect LED light output. The second difference is that the photodetector structure of the embodiment of FIGS. 4 and 5 corresponds to that on the LED monolithic chip array of FIG. 9 whereas the photodetector metalization structure of the embodiment of FIGS. 6 and 7 corresponds to that on the LED monolithic chip array of FIG. 8. The photodetector array is just another array of LEDs in cross-section with an exception that it is used in a photodetector mode of operation wherein it senses subsurface light generated by a corresponding LED. The concept is valid in general for all material systems (GaAsP, AlGaAs, etc.) of light emission and detection.

FIG. 8 illustrates a monolithic chip array 200 of integrated LED/photodetectors that also has provisions for independent access to all LEDs and photodetectors. This device is fabricated with appropriate design of the metallization mask level. With this design, the number of wirebonds to the driver chips will be effectively doubled resulting in higher manufacturing costs. As shown in FIG. 8 a central row of LEDs 210 is provided. A row of bond pads 221 is provided to each side of the row of LEDs so that each LED is electrically connected by a conductive trace to an enlarged bond pad. A wire bond connects a current driver channel on the driver chip to a respective LED's bond pad. The current is then conducted from the bond pad to the electrode 211 overlying the LED. An additional row of bond pads 201 is also provided to each side of the row of LEDs outboard of the row of LED bond pads. The bond pads 201 are connected by suitable conductive traces to individual discrete photodetectors associated with each LED. The bond pads 201 are also connected by wire bonds to respective driver chips located to either side of the LED chip array similar to that shown in FIG. 11.

With reference now to FIG. 9 illustrated therein is an array of integrated LED/photodetectors with commonly-connected conductive leads. This structure is made possible by appropriate design of the metallization level mask. Only one or two additional wirebonds at either or both ends of the device array are necessary. As may be seen in FIG. 9 the LED monolithic chip array 100 includes a central row of LEDs 110' that are uniformly sized and spaced as is well known. A row of bond pads 121 is situated to each side of the row of LEDs with bond pads of adjacent LEDs located in different rows in an alternating relationship to allow the bond pads to be relatively larger in size than the LEDs. In the embodiment shown a single bond pad 101, 102 is located adjacent each end of the chip array and connected by conductive leads or traces 103, 104 respectively to metalization associated with photodetectors opposite the end LEDs on the chip array. In the chip array 100 each LED has adjacent thereto a photodetector 130' which is located on the opposite side of the LED from the LEDs bond pad. This allows for convenient access for the LEDs electrode leads 111'. Metalization is associated with each of the discrete photodetectors so that conductive traces follow a serpentine path 133' about the LEDs. This allows the current generated by any discrete photodetector to be conducted to either bond pads 101 or 102 from which this current can be carried to a respective driver chip that is located to either side of this chip array and connected to the respective bond pads 101, 102 by wire bonds. For the chip array 200, 100, typically it is preferred, although not a requirement, that the current for the odd numbered LEDs will be sensed and detected by one driver chip and the current for even numbered LEDs will be sensed by the other chip. However, in the arrangement of photodetectors of the chip array 100 it is necessary for the LEDs to be separately energized in time and this may be done during a test period such as prior to assembly of the printhead wherein modules may be separately tested or when the printhead is assembled but the test is run during interframe periods or other periods when recording is not being done. The wirebond for connecting a driver chip to the photodetectors on chip array 100 can be at the photodetector elements or at other locations on the chip array since there is negligible ohmic drop whether the photocurrent is sensed at the first element or hundreds of elements away. A high speed clock signal can be utilized to survey the level of performance of each parent LED by measuring the associated photodetector response, using just one more wirebonded terminal.

FIG. 10 illustrates a monolithic chip array 300 of integrated LED/photodetectors that also has provisions for independent access to all LEDs and photodetectors. This device is fabricated with appropriate design of the metallization mask level. With this design like that of the embodiment of FIG. 8, the number of wirebonds to the driver chips will be effectively doubled resulting in higher manufacturing costs. However, with the chip arrays of this embodiment, dynamic real time feedback from the photodetector to the control electronics on the driver chip is provided and the resulting real time control of the intensity of light emission from the LEDs is possible with this configuration. As shown in FIG. 8 a central row of LEDs 310 is provided. A row of bond pads 321 is provided to each side of the row of LEDs so that each LED is electrically connected by a conductive trace to an enlarged bond pad. A wire bond connects a current driver channel on the driver chip to a respective LED's bond pad. The current is then conducted from the bond pad to the electrode 311 overlying the LED. An additional row of bond pads 301 is also provided to each side of the row of LEDs outboard of the row of LED bond pads. The bond pads 301 are connected by suitable conductive traces to individual discrete photodetectors associated with each LED. The bond pads 301 are also connected by wire bonds to respective driver chips located to either side of the LED chip array similar to that shown in FIG. 11. In this embodiment the row of bond pads 301 for the photodetectors is on the same side of the chip array as the row of LED bond pad 321 considering the row of LEDs divides the chip arrays into sides. Thus, in this embodiment the same driver chip that drives the LEDs is also connected to the corresponding photodetectors of these LEDs. As may be noted from FIG. 10, conductive traces from the photodetectors to the respective bond pads for each photodetector extend in a space between two adjacent LEDs. In order to avoid having such a trace be too close to an end of the chip array, traces from two of these photodetectors pass through a space between LED N and LED (N−1) near one end of chip array 300.

Figure 11:
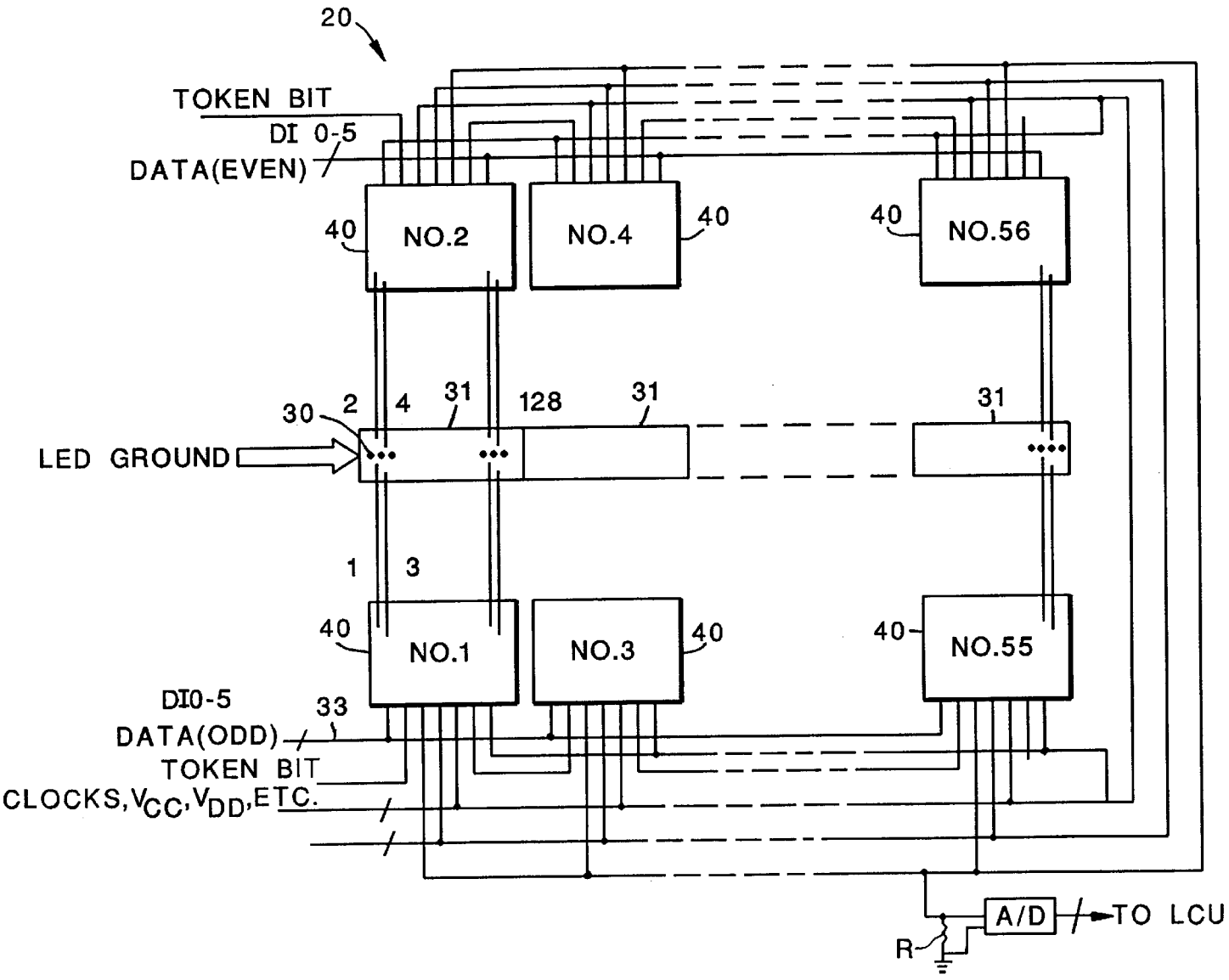
FIG. 11 (Prior Art)
FIG. 11 is a schematic of an LED printhead as known in the prior art.

The printhead that is adapted to use LED chip arrays of the invention is typified by the diagram of FIG. 11 wherein a linear array of several thousand triggerable light-emitting elements; e.g. LEDs, is disposed to expose selectively a photosensitive image-receiver medium that is movable relative to the array by suitable conventional means (not shown). While the embodiments of the invention will be described in terms of LED printheads, other light-emitting elements may also make use of this invention, such as lasers. Optical means for focusing the LEDs onto the medium may also be provided. In this regard, gradient index optical fiber devices such as Selfoc (trademark of Nippon Sheet Glass Co., Ltd.) arrays are highly suited. The LEDs of the array are triggered into operation by means of image processing electronics 40 that are responsive to image signal information. Depending on the duration for which any given LED is turned on, the exposure effected by such LED is more or less made. Where the medium is, say, photographic film the latent image formed line by line by selective exposure of said LEDs may be subsequently developed by conventional means to form a visible image. Where the medium is an electrophotographic receptor, the LEDs may be used to form an electrostatic image on a uniformly electrostatically charged photoconductor and this image developed using opaque toner particles and perhaps transferred to a copy sheet. As used herein, the term "'light emitting" is not intended to be limited to the visible radiation spectrum.

Typically, a data source such as a computer, word processor, image scanner or other source of digitized image data, provides image data signals to a data processor which may comprise a raster image processor or other processor. The data processor under control of clock pulses from a logic and control device (LCU) provides a plurality of outputs including rasterized data outputs and control signals which are fed to the printhead. Data for each pixel may be represented by a multibit signal of say 4 bits representing a grey level for exposure for recording that pixel. A RAM memory device may be provided either on or off the printhead to modify the data to provide for uniformity correction from LED to LED. In this regard, see U.S. Pat. No. 5,300,960, the contents of which are incorporated herein by this reference. The memory transforms the 4-bit signal into a 6-bit grey level signal that is adjusted or corrected for the light-emitting characteristics of the respective LED. This balance in light output from LED to LED can be corrected by modifying the data bit signals in accordance with empirical determinations. The memory has stored therein approximate correction factors associated with each LED for modifying that LED's respective data. As will be described below, this memory may be modified in accordance with age and/or temperature changes to the printhead. The description of the circuitry forming a part of the driving circuitry for distributing the image data signals to an appropriate comparator and to current driving circuits will now be described.

In the example of the circuitry for the printhead shown in FIG. 10, the driving circuitry for the LEDs are provided on opposite sides of the line of LEDs 30. This is a known desirable arrangement for permitting LEDs to be packed closer together to provide greater image resolution capabilities for the printer. As may be noted the circuit arrangement is an alternating one such that what may be called the even-numbered LEDs have their respective driving circuitry located to one side of the line of LEDs and what may be called the odd-numbered LEDs have their respective driving circuitry located to the other side of the line of LEDs. Typically, groups of, say, 64 of the odd numbered LEDs (in a chip array 31 having 128 LEDs arranged in a row) will have their respective driver circuitry formed in a single integrated circuit chip 40 and thus, for a printhead having several thousand LEDs on the printhead, there may be for example 28 driver chips located on each side of the line of LEDs. In order to save on production costs for these driver chips, it is desirable that they be identical. For the driver chips to be identical, although locatable on either side of the line of LEDs, it is desirable for design simplicity that signals traversing the length of the printhead be programmably movable in either direction; see in this regard U.S. Pat. No. 4,746,941. LED chip arrays having more than 128 LEDs are also known but the invention will be described with reference to those having 128 LEDs.

Figure 12:
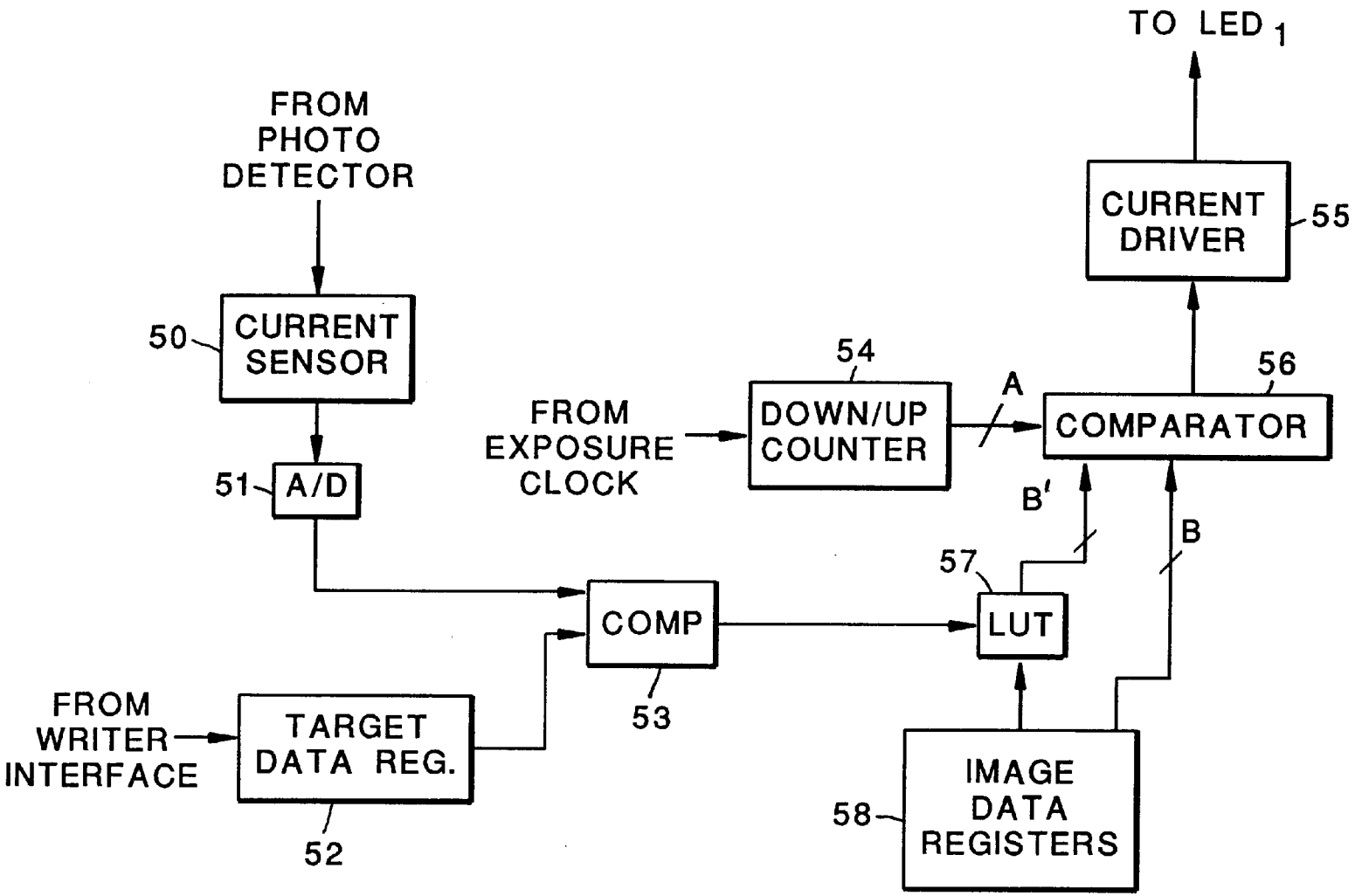
FIGS. 12 and 13 are schematics of circuits for, real time adjustment of pulse time or current to an LED provided on a printhead having monolithic devices of the type shown in FIG. 10.

With reference now to FIG. 12, a schematic is provided of a circuit for incorporation on a driver chip and which is associated with each current driver channel for providing current to each LED on a chip array 300 such as shown in FIG. 10.

An exposure clock provides exposure clock pulses to a down/up counter 54 which, when enabled by a signal from a logic and control unit (not shown) counts such clock pulses and provides at an output having a plurality of lines a digital signal representation of the state of the counter. Typically, such a counter has one line representing a least significant bit of such count and other lines representing other more significant bits. In accordance with a technique fully described in U.S. Pat. No. 4,750,010 in the names of Ayers et al, the output of the counter 54 is provided to a first set of input terminals to a comparator 56 associated with each light-emitting element 30, i.e., LED in this embodiment. A plurality of data lines from each of a plurality of corresponding data registers 58 is also provided to a second set of input terminals associated with each comparator 56. The comparator compares the output of the counter 54 with the value of the respective image data. The image data signals provided to each comparator relates to a desired ON time or period of enablement for a respective LED 30 for the recording of a respective pixel. As shown in FIG. 11, the LEDs are alternately divided into odd and even-numbered LEDs so that respective integrated circuit driver chips 40 therefor are located on opposite sides of the line of LEDs. As the circuitry is identical for the corresponding driver chips, the discussion herein will be made as to one of these driver chips. The image data signals provided to each comparator during the printing of a single line of dots by the row of LEDs is related to the desired pixel or dot size to be exposed onto the image receiver medium by that LED for that particular line of dots. As shown in FIG. 11, six independent lines of data D10 through D15 provide a six bit digital image data signal that allows for grey-scale variation of the output of each LED during each cycle of operation. During each cycle the data to each comparator may comprise six binary bits representing an amount from decimal 0 to decimal 63.

Suppose, for example, that an LED, $LED_1$, is to be enabled for a time period equal to 20 clock periods plus $T_{MIN}$. $T_{MIN}$ represents a pre-established minimum LED on time. In response to a start pulse, the counter 54 is enabled and commences to count exposure clock pulses from decimal 63 to 0. Note that the clock pulses may be generated to have a variable programmable period. The six bit output of counter 54 is coupled to one set of inputs at terminal A of each of the comparators. This count is now compared with the data input at another set of inputs at terminal B of this comparator which represents in binary form decimal ten. When there is a "match," i.e., the count of terminal A is 10, a pulse is provided at the output terminal of comparator 56 to cause a constant current driver 55 to commence and maintain current to $LED_1$. After the counter counts down to zero, the counter may be inhibited from counting additional clock pulses for a period $T_{MIN}$ that is either programmed into the counter or provided by other suitable means. After this predetermined time period $T_{MIN}$, if used, the counter is set to count in its up mode and commences counting clock pulses again. When the counter, in its count up mode, reaches decimal 10 current to the LED ceases. The other LEDs, etc. operate in similar fashion but their data may require different count values to turn on and off. What these LEDs will thus have in common is that all will have their respective current pulses centered, i.e., the midpoints of the respective current pulses will occur at the same time. The pulse duration for each LED during each line of print is varied, however, in accordance with their respective corrected image data signals.

Assuming now that the printhead includes a series of LED chip arrays 300 such as shown in FIG. 10 wherein each current driver channel is wire bonded or otherwise connected to an LED pad 321 and a current sensor on the driver chip and associated with that LED is connected with a wire bond to the bond pad 301 of the respective photodetector 330 associated with that LED 310. A signal such as photocurrent generated by a photodetector in response to subsurface light generated within a particular enabled LED is converted in real-time to a digital signal representing such photocurrent by an A/D converter. A register 52 is also provided that stores a digital signal related to a desired or target light output. This target data signal is based on a value determined empirically and stored in the register by the LCU. The target and actual sensed signals are compared in a comparator 53 and a value associated with the difference serves as an address input to a look-up table (LUT) 57. A second address input to the lookup table is provided from the image data registers 58 or latches which provide exposure duration information for recording the current pixel. If there is a mismatch between the target and the actual light outputs, the LUT 57 provides an adjusted image data signal B' to the comparator 56 that is used by the counter during the up-count half of the recording period so that effectively the exposure duration for recording the current pixel is either increased or decreased.

Figure 13:
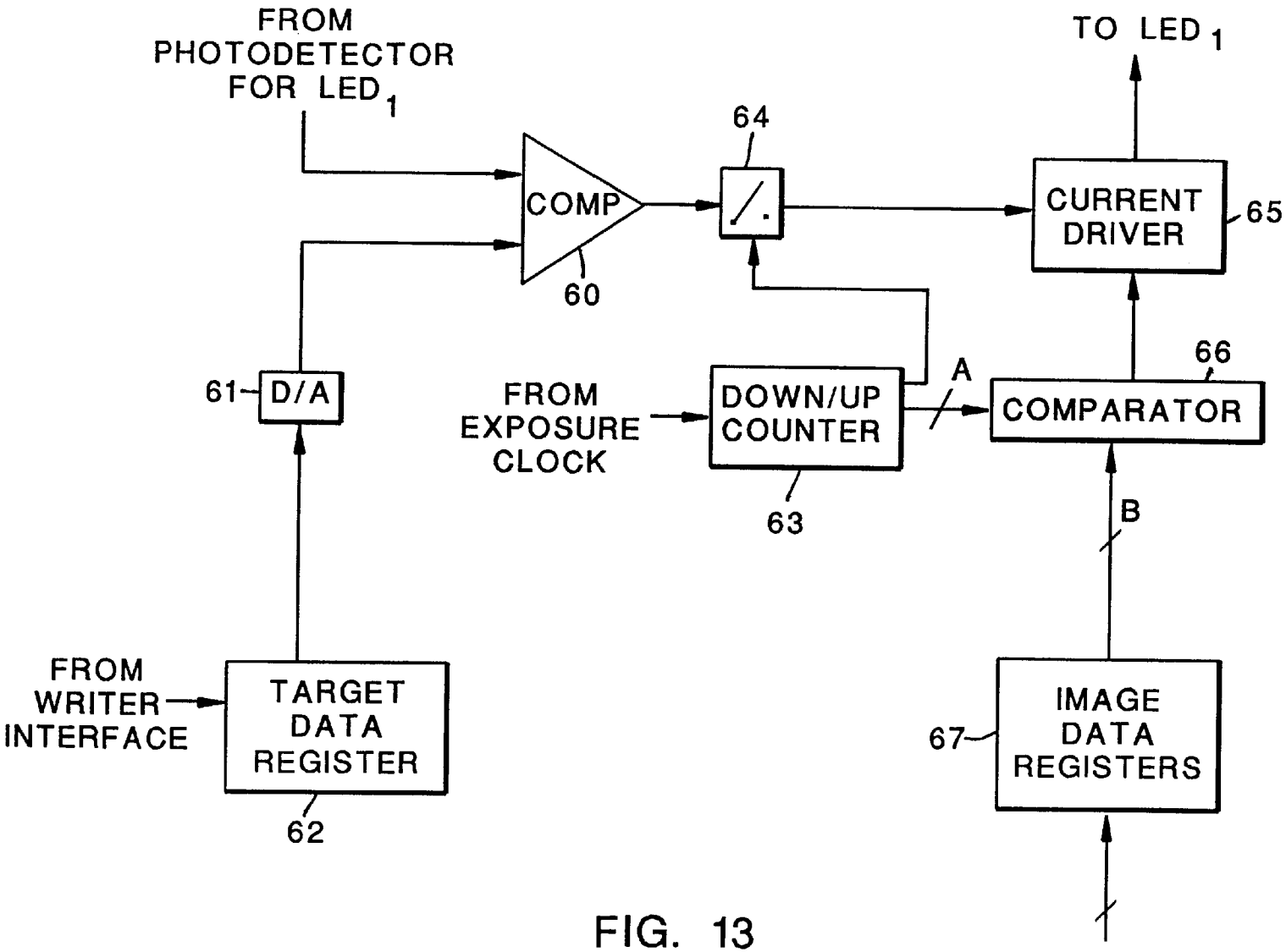

An alternative driver circuit for use with the LED chip array 300 of FIG. 10 is illustrated in FIG. 13 wherein the electrical current or potential from each photodetector 230 is provided in real-time as one input to a respective comparator 60 located on a driver chip. A second input to the comparator 60 is an analog signal that is generated by having a D/A converter 61 convert to analog form a digital signal stored in a target data register 62. The comparator compares the two inputs and generates a difference signal that is used to adjust current during a portion of the pixel recording cycle. For example, when the up-counting portion of the cycle is commenced, a signal from the down/up counter 63 closes a gate 64 to enable the difference signal to be input to the current driver 65. The current driver will then adjust current to the LED during the latter half of the pixel recording period. Suitable circuits for use in the current driver 65 may include a transistor whose bias is affected by the signal from the comparator or other circuits that may be enabled to either add or reduce current to the LED driver channel output for that LED in accordance with the output of the comparator 60. The operation of the counter 63, comparator 66, and image data registers 67 are similar to that described in the prior art and discussed above for controlling pulsewidth duration for recording a pixel.

Figure 14:
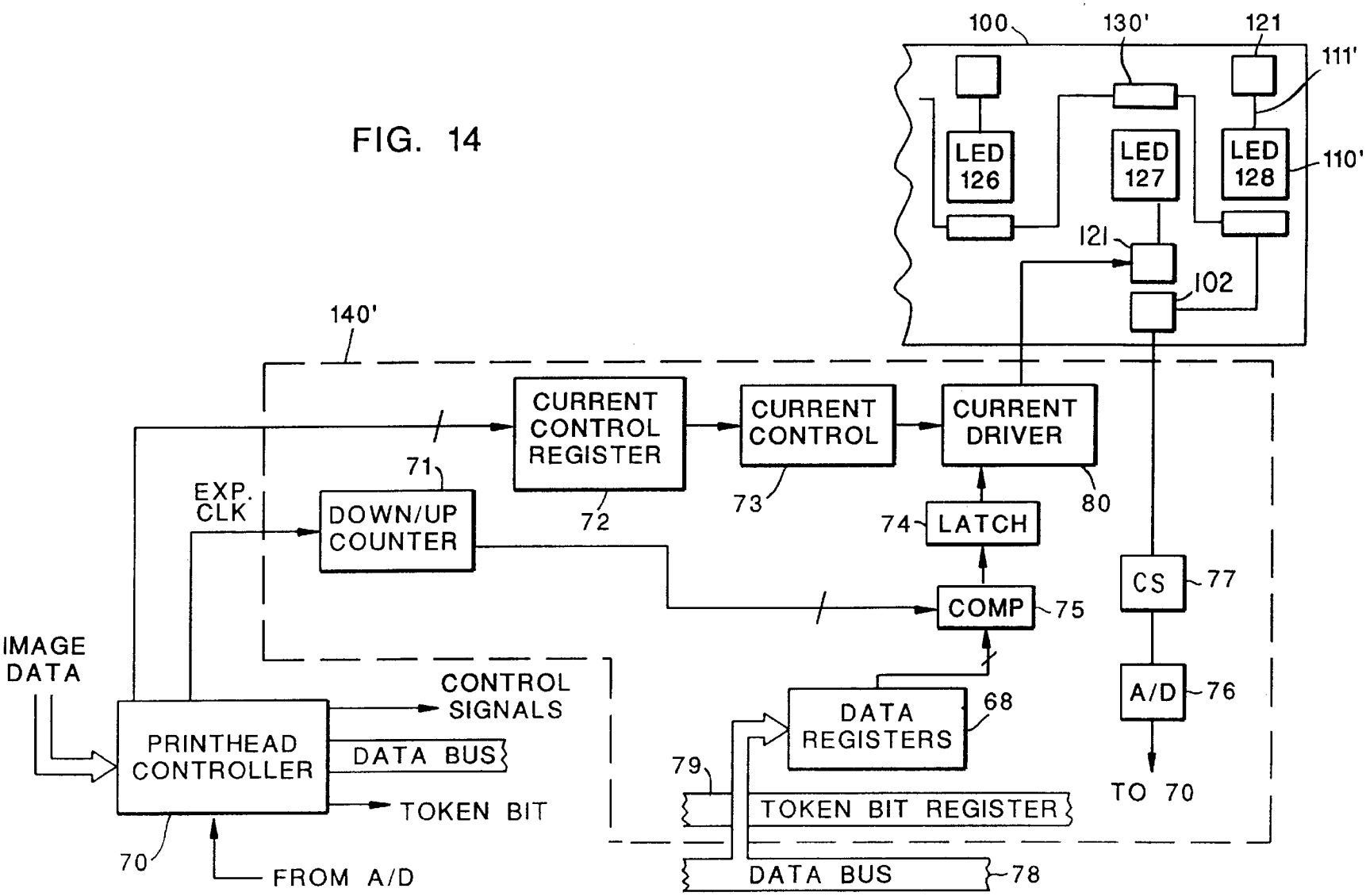
FIG. 14 is a schematic of a circuit for adjustment of pulse time or current to an LED provided on a printhead having monolithic devices of the type shown in FIG. 9.

The LED chip array configuration of FIG. 9 is preferred even though it is not suited for real time control of exposure during actual printing. In the configuration shown only two extra wire bonds are required for connection to the LED chip array to monitor current in any of the 128 channels. With reference to FIG. 14 an end portion of an LED monolith array of the type shown in FIG. 9 is illustrated with a portion of a driver chip shown having one channel for driving one of the LEDs, LED 127. Current monitoring is accomplished by sending test image data to the printhead or to a print module that has not yet been assembled into a printhead. Examples of a print module are provided in U.S. Pat. No. 5,389,953. The test image data will be such as to enable only one of the 128 LEDs on this chip array and the light output of this LED is monitored by its respective photodetector which generates a current that is shunted through the metallization that connects all the photodetectors to the bond pad associated with the driver chip that provided the enabling test data. This current can then be detected by detectors on the driver or fed by the driver to detectors to the driver and the value thereof, quantified and determined by controls associated with the printer to determine if a change in correction is required for that LED by say changing the corrected image data factors of all the LEDs by general correction of current; see for example U.S. Pat. No. 5,253,934 the pertinent contents of which is incorporated herein by reference. Each of the LEDs on the LED chip array module or printhead thus can separately in turn be enabled and their currents respectively determined.

In the circuit shown in FIG. 14 grey level image data from a suitable source such as a scanner, computer, etc. is processed by suitable means not shown such as a raster image processor and input to a printhead controller 70 which stores the rasterized data and outputs on a data bus on the print head in a controlled sequence of say a 6 bits per pixel data stream. The six bits per pixel data stream may represent 15 grey levels of image data corrected for LED nonuniformities in accordance with the techniques described for example in U.S. Pat. No. 5,300,960. Also output to the printer are exposure clock pulses, a multibit signal representing current control data, a token bit and clock signal therefor that causes the token bit to be shifted down a token bit register 79 that is formed by a serial connection of registers in the driver chips. Respective current control data is input to a current control register 72 on each driver chip and controls current in a master current control circuit 73 to which each of the current driver channels 80 (only one channel is shown) in a driver chip 140 is stored. The exposure clock pulses are input to a down-up counter on each driver chip. The output of the down-up counter is input to one input of a comparator 75 which also receives an input of data from data registers 68 that store a six bit data signal representing a duration for recording a pixel by one LED in the example LED 127. A controlled amount of current is thus generated by the current driver circuit for a period determined by data in the data registers 68 and the count values of the down-up counter 71 and which are output to the comparator 75. A latch register 74 is provided to hold the current driver 80 in an enabled state for the period determined by operation of the comparator. Further description of operation of this embodiment is provided in U.S. Pat. No. 5,389,953 the contents of which are incorporated herein by reference.

The output of the current driver is input via say a wirebond or other connection to an input pad 121 connected by a conductive lead with LED 127. In a test mode, image data may be provided on the data bus and latched in the registers associated with one LED's driver channel. Assume that each of the LEDs are to be tested in turn for light intensity emissivity. For example, this test could be done during an interframe, at startup, during service diagnosties, etc. Data for that LED is sent down the data bus and the location of a token bit enables the data register of that LED's driver channel to latch the data. In response to various control signals and exposure clock pulses only the current driver channel that has received image data is enabled and the respective energization of LED 127 occurs without other LEDs on that LED chip array also being enabled. Therefore the photodetector associated with LED 127 generates current or potential which is output from the pad 102 on the LED array 100 by a wire bond or other connection to the driver chip. The output current or potential is sensed by a current sensor 77; for example, a resistor formed on the chip or external thereto. This analog current value or alternatively voltage or potential value may be converted to a digital signal by an A/D converter 76 and a digital value communicated to the printhead controller 70. In receiving the various inputs of current related values from other LEDs on LED chip array and driven by driver chip 140 the printhead may compare these values with data representing target values and make adjustment by changing data sent to the current control register 72. Alternatively, changes may be made through adjustment of exposure time.

The chip array embodiment of FIG. 8 may also be used in a similar manner to that of FIG. 9 since a driver chip may include circuitry for detecting photocurrent and be in communication with a controller for passing information relative to such photocurrent to the controller. In the embodiment of FIG. 8 the driver chip that drives an LED is not the same driver chip to which the photodetector is connected.

Figure 15:
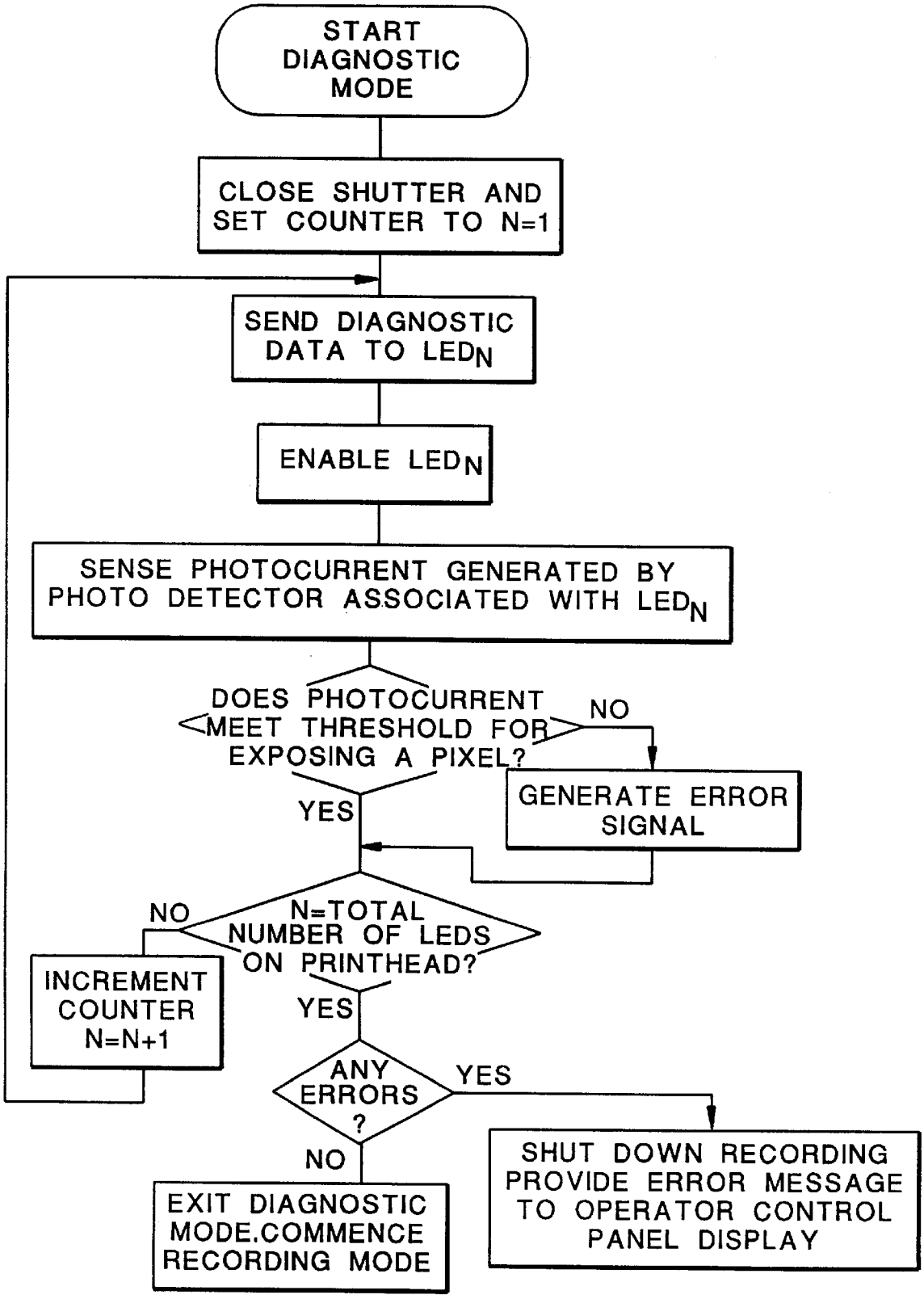
FIG. 15 is a flowchart illustrating operation of a printhead using the LED monolithic device of FIG. 9 in an archival recording device.
Figure 16:
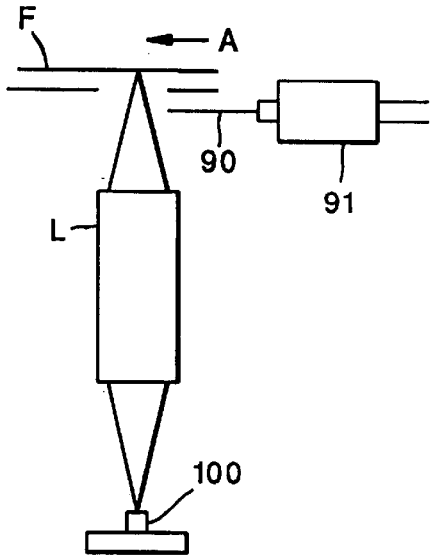
FIG. 16 is a schematic of an archival recording printer in accordance with one embodiment.

The LED arrays of the invention are particularly suited for use in archival recording systems. For example, it is known to use LED printheads to expose image information onto microfilm for recording of the information for archival storage. Typically, after the information is recorded, the film is processed and not reviewed until needed. However, the use of such printheads for such recording can be improved by providing some means for ensuring that all the LEDs are operative. In one approach in accordance with the invention, there is provided a diagnostic mode after each image frame of recording is made using a printhead formed of arrays such as those illustrated in FIGS. 8 or 9. With reference to the flowchart of FIG. 15 and the schematic of FIG. 16, a printhead is formed of LED arrays 100 arranged in a row as described above. Driver chips are associated with each LED and may be of the type illustrated with each LED and may be of the type illustrated in FIG. 14. Light from the LEDs is used to expose microfilm F through a reduction lens L. In response to a signal from the printhead controller 70, a diagnostic mode is entered during startup and after each image frame is recorded on the microfilm. In this mode, a shutter blade 90 is moved to a "closed" position where the blade blocks light from exposing the microfilm F. During the diagnostic mode, the film may be stationary or moving in the direction of arrow A. The advancing means for the film may be a stepper motor or other drive source whose movement is controlled. When an interframe is reached as indicated by, for example, an end of data signals for that frame or by a specific amount of travel of the film, the shutter is closed say under operation of solenoid 91 or other known device and a counter associated with the printhead controller is set to N=1. Data is then sent via the data bus 78 to the first LED and this LED is enabled; i.e., illuminated. Light from this LED is blocked from exposing the microfilm but is sensed by the photodetector 130' associated with that LED 110'. The photogenerated current or voltage potential is detected by A/D converter 76 and communicated to the printhead controller 70 which determines in accordance with a criterion if the amount of current or potential is adequate; i.e. above a predetermined threshold level indicating the LED is fully operational for recording of pixels. If the level of the current detected indicates the LED is not sufficiently operational, an error signal is stored in a memory associated with controller 70 in accordance with the identity of that LED. The LED counter is then incremented and data sent to the next LED and the output of its photodetector detected and determined if it is operational, too. This process repeats for each of the LEDs. If all the LEDs are considered fully operational, an exit is made of the diagnostic mode and the next image frame can be recorded with removal of the shutter blade from its blocking position. If errors signals are noted, recording is terminated and an error message noted on the printer's operator control panel display. The printhead controller 70 retains for storage the identity of the LEDs determined not to be operational. Although the above process is particularly suited for a medium such as microfilm or other photosensitive medium that is not expected to be viewed immediately due to requirements for later processing, the process and apparatus can be used in other apparatus, such as electrophotographic recording apparatus.

Figure 17:
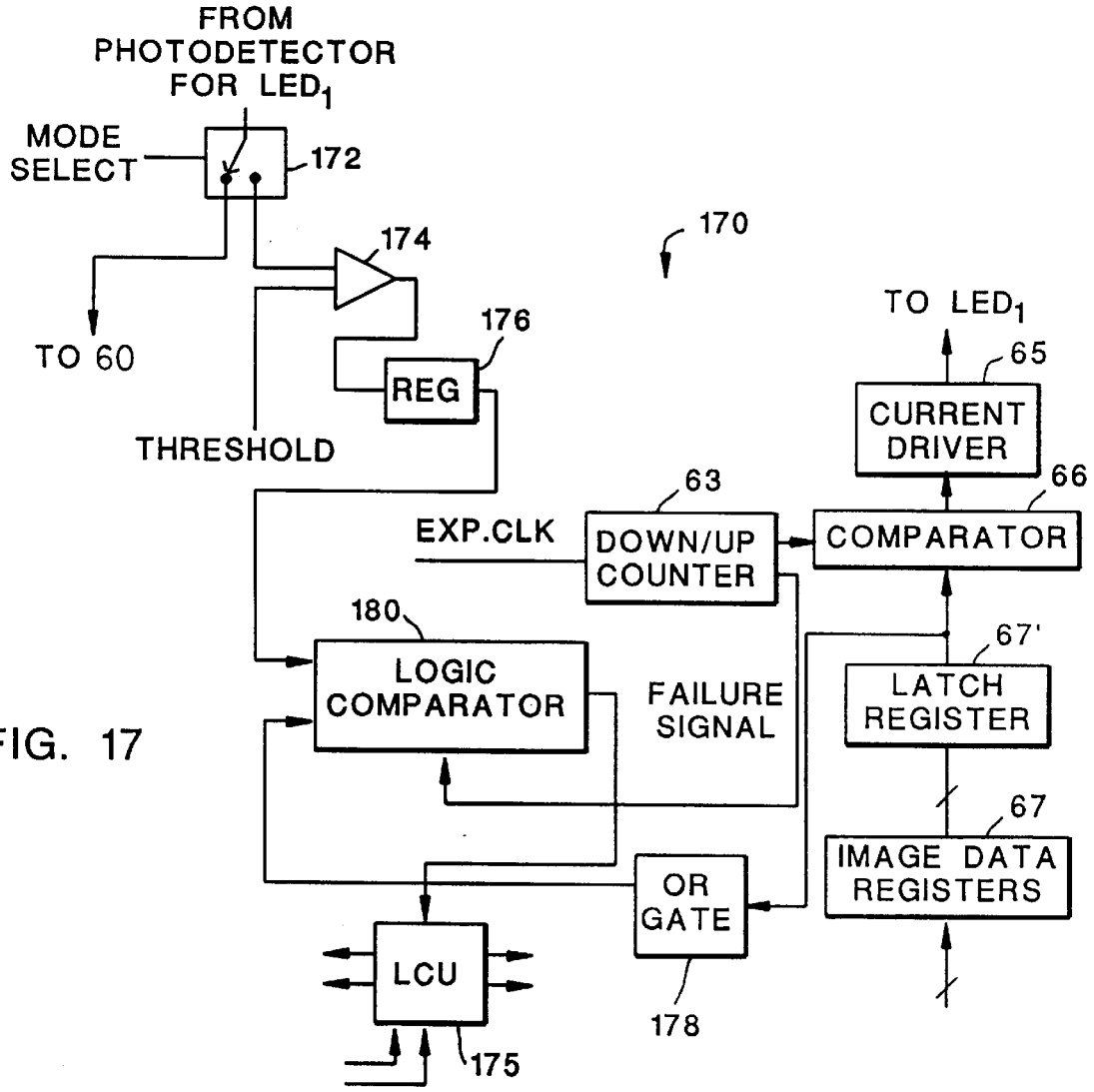
FIG. 17 is a circuit forming a part of a driver circuit associated with an archival recording printer in accordance with a second embodiment and using the LED monolithic device of FIG. 8.
Figure 18:
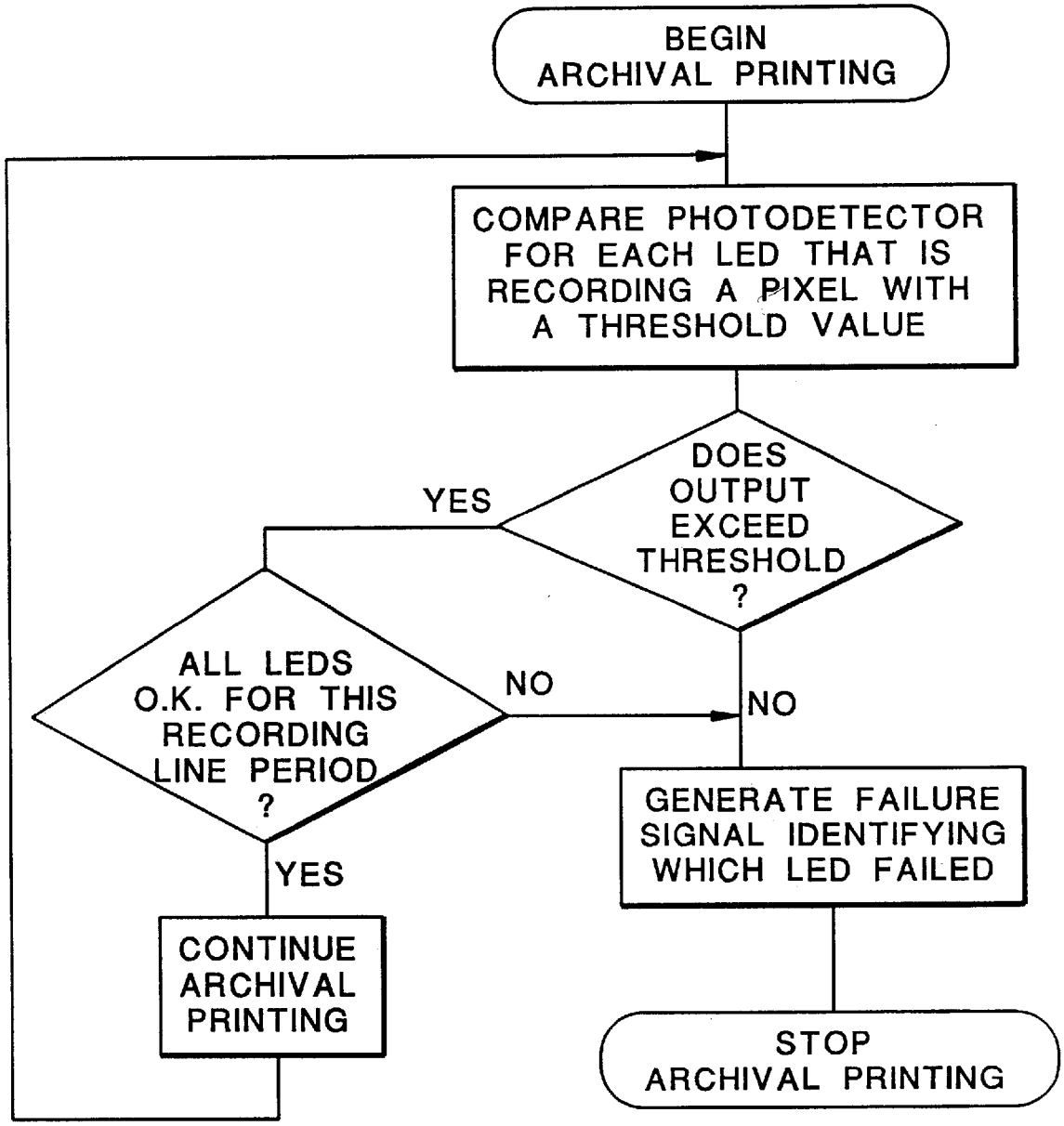
FIG. 18 is a flowchart indicating operation of the printer of FIG. 17.

As noted above, the LED chip array 300 of FIG. 10 includes photodetectors whose outputs can be detected in real time during imaging. This has particular advantageous use in archival recorders where assurance can be provided that recording of each pixel may be monitored. In this regard and with reference now to the circuit of FIG. 17 and flowchart of FIG. 18, current or voltage potential from each photodetector associated with each LED may be detected during each recording line period for recording a row of pixels by the LEDs of the printhead. The circuit 170 of FIG. 17 may be incorporated in each driver chip driver channel either in combination with the circuits of either FIG. 13 or that of FIG. 12 or without same. Where the circuit of FIG. 17 is so combined, a switch 172 may be provided to enable switching of the photodetected current for detection in accordance with each mode, or alternatively, portions of the circuits combined. In any event, in response to enablement of an LED, its associated photodetector generates say a photocurrent which is compared with a threshold representing a minimal signal that indicates operability of the LED. A one-bit digital signal is output by the thresholder 174 and indicates whether or not the detected voltage is above or below the acceptable threshold. A one-bit register 176 stores the decision of thresholder 174. As known in the prior art, a latch register 67' may be associated with the image data register 67 and stores the image data bits that are used for recording the present pixel. These data bits are also output from the latch register 67' to an OR gate 178 wherein the data bits are "ORed" together or subject to a logic OR operation by the logic OR gate 178 so that if there is any data being printed during this pixel recording line period by the respective LED, the output of the OR gate 178 will so indicate with a single bit logic signal. A logic comparator 180 compares the output of OR gate 178 with that of register 176 to determine if there is a match. If there is no match, an error or failure signal is generated by logic comparator 180 to a logic and control unit 175 which may be off or on the printhead to indicate a potential recording error in which case the recording may be discontinued or some notation or message provided indicating the error. The noting of a failure may be followed by a diagnostic mode for determining whether or not this is an error not likely to repeat. The operation of the comparator 180 may be synchronized with a signal from the down-up counter 63 so that when the counter reaches 0 after counting down and changes to a count-up mode, all LEDs that are being used to record data for this pixel line period will be enabled. This is only one exemplary way of ensuring that the comparison between data and detected light output occurs during a period of enablement of the LED. Other means which may be used could include detection of a signal for causing operation of the current driver 65 and comparing such a signal with an output of the photodetector associated with that LED.

It has thus been shown that an assembly of the above-mentioned integrated LED/photodetector with driver chips or circuitry are used to form an LED printhead with a built-in function for sensing the state of performance of each LED contained. The available photocurrent signal can be used at the writer subsystem level for various applications such as a diagnostic tool at writer manufacturing to ensure that all LEDs are emitting light when addressed from the control electronics. In practice, for instance, it is known to have writer failures at manufacturing where erroneous double wirebonds at single LEDs result in fully addressable printheads that cannot be detected by overfilled radiometric detectors (the errors will occur at adjacent LEDs generally) even though the process of error has left an LED without a wirebond. Thus, where a radiometric detector or photodetector is located for test purposes in the image plane of the imaging lens, it may not detect that an LED is unconnected if the bondwire for that LED is connected to an adjacent LED. The reason for this is that there is some light from the adjacent LED that will spread and be detected by the detector. This failure may be undetectable until final assembly of writers into an electrophotographic engine. A second application is in uniformity improvement for LED printheads whereby the current to each LED is trimmed with control electronics to result in the same photocurrent at all associated photodetectors. A third application is in detecting aging during use in the field. The photodetector signals can be acquired and stored on an onboard memory during manufacture, used as baseline data and compared against field use at customer sites for the detection of differential aging of pixels. This feature will be useful as an objective decision-making tool for the field engineer, when dealing with gray scale writers and having to make judgments on the recalibration of such writers. A fourth application, as discussed above, is use as a dynamic real-time control of light emission intensity of LEDs based on feedback of signal from photodetectors. A fifth application is in ensuring operation of each LED, and thus, the arrays described herein are particularly suited for use in archival recording systems.

The implementation of the current invention will not result in additional LED chip cost, since the same process is used to form LED chip arrays without photodetectors and no extra real estate is required. With the embodiment of FIG. 9, one or two more wirebonds are required per chip to collect the photocurrent and an additional channel is required at the writer interface to acquire and use the data for decision making. In lieu of wirebonds other connecting means may be provided and the chips may be connected without wirebonds such as when in a flip-chip configuration.

The invention has been described in detail with particular reference to preferred embodiments thereof and illustrative examples, but it will be understood that variations and modifications can be effected within the spirit and scope of the invention.

What is claimed:

1. A monolitic device comprising:

(a) a semiconductor substrate;

(b) an array of plural light-emitting elements fabricated in the substrate, the elements being arranged in a row;

(c) a set of respective bond pads and each of the bond pads connected with a respective one of the light-emitting elements for providing respective currents for energizing respective light-emitting elements to emit light, a portion of the light being subsurface light that does not exit the device and another portion of the light being light that does exit the device, the bond pads for adjacent ones of light-emitting elements being located on opposite sides of said row;

(d) a set of respective photodetectors fabricated in the substrate with a respective photodetector being located respectively adjacent each respective light-emitting element; each respective photodetector being located on an opposite side of said row from a respective bond pad and positioned in sufficiently close proximity to the respective light-emitting element to sense subsurface light emitted by the respective light-emitting element and which subsurface light does not exit the device.

2. The device of claim 1 and wherein there are a plural number N of light emitting elements on the device and a similar number N of first bond pads and a similar number N of second bond pads on the device and wherein the second bond pads are each respectively located further from a respective light-emitting element than a respective one of said first bond pads and the second bond pads are each electronically connected to a respective one of the photodetectors.

3. The device of claim 2 and wherein there are two rows of second bond pads located on the device with the row of light-emitting elements being located between the two rows of second bond pads.

4. The device of claim 1 and wherein there is metallization associated with each photodetector for carrying a current related to light sensed by a respective photodetector and there is a metallization connection electrically connecting each adjacent pair of photodetectors and the metallization connection is located between adjacent light-emitting elements.

5. The device of claim 4 and wherein the metallization connections form a serpentine path about the light-emitting elements and electrically interconnect plural of the photodetectors.

6. The device of claim 5 and wherein a second bond pad is provided on the device and the second bond pad is electrically connected through the metallization connections to plural photodetectors.

7. A monolithic device comprising:

(a) a semiconductor substrate;

(b) an array of plural light-emitting elements fabricated in the substrate, the elements being arranged in a row; each of light-emitting elements being capable of emitting light, a portion of which exits the device and another portion of which that does not exit the device; and (c) a set of respective photodetectors fabricated in the substrate with a respective each one of said photodetectors located in sufficiently close proximity to a respective light-emitting element for sensing subsurface light of the respective element which subsurface light does not exit the device.

8. The device of claim 7 and wherein each photodetector is located on an opposite side of said row from a respective photodetector of an adjacent respective light-emitting element.

9. The device of claim 8 and wherein there are a plural number N of light-emitting elements on the device and a similar number N of photodetectors on the device.

10. The device of claim 8 and wherein the photodetectors each include a p-n junction that is of the same composition as a p-n junction that forms a part of each light-emitting element.

11. The device of claim 9 and wherein there is metallization associated with each photodetector for carrying a current related to light sensed by a respective photodetector and there is a metallization connection electrically connecting each adjacent pair of photodetectors and the metallization connection is located between adjacent light-emitting elements.

12. The device of claim 11 and wherein the metallization connections form a serpentine path about the elements and electrically interconnect plural of the photodetectors.

13. The device of claim 12 and wherein a bond pad is provided on the device and the bond pad is electrically connected through the metallization connections to plural photodetectors.

14. The device of claim 13 and wherein the substrate is gallium arsenide.

15. The device of claim 8 in combination with first means for sensing a signal from a photodetector and second means responsive to said signal for changing a parameter related to current to a light-emitting element whose light is sensed by the photodetector.

16. The combination device of claim 15 and wherein said parameter related to current is exposure time.

17. The combination device of claim 16 and wherein said second means changes said parameter related to current in real-time during a recording of a pixel.

18. The combination device of claim 15 and wherein said parameter related to current is amount of current.

19. The combination device of claim 18 and wherein said second means changes said parameter related to current in real-time during a recording of a pixel.

20. A method of diagnosing error in operation of one of plural light-emitting elements on a monolithic device, the device including (a) a semiconductor substrate; (b) an array of plural light-emitting elements fabricated in the substrate, the elements being arranged in a row; and (c) a set of respective photodetectors fabricated in the substrate with a respective each one of said photodetectors located in sufficiently close proximity to a respective light-emitting element for sensing light of a respective element which light does not exit the device, said method comprising:

providing data to a driver associated with said one of the light-emitting elements;

in response to said data, enabling said one of said light-emitting elements to emit light, a portion of the light exiting the device and another portion of the light not exiting the device (non-exiting light);

sensing a first signal representing an output parameter by a photodetector and associated with the emission of non-exiting light by said one of said light-emitting elements;

establishing a criterion for determining error between presence of data and sensing of said first signal; and generating a second signal representing an error in response to comparing of said first signal with said criterion.

21. The method of claim 20 and including the steps of closing a shutter prior to the step of enabling to block light from the light-emitting elements from exposing a photosensitive recording medium.

22. The method of claim 21 and wherein at least one of the light-emitting elements are enabled to record image information on the photosensitive recording medium when the shutter is not closed.

23. The method of claim 22 and wherein diagnosing of error is made during an interframe recording period between periods for recording of image frames on the recording medium.

24. The method of claim 20 and wherein sensing of said first signal is made in real-time during a recording period for recording pixels by said light-emitting elements on a photosensitive recording medium.

25. An apparatus for determining malfunction in operation of one of plural light-emitting elements on a monolithic device, the device including (a) a semiconductor substrate; (b) an array of plural light-emitting elements fabricated in the substrate, the elements being arranged in a row; and (c) a set of respective photodetectors fabricated in the substrate with a respective one of said photodetectors located sufficiently proximate each respective light-emitting element for sensing subsurface light of a respective element a portion of which subsurface light does not exit the device (non-exiting light), said apparatus comprising:

means for providing data to a driver associated with said one of said light-emitting elements;

means for enabling, in response to said data, said one of said light-emitting elements;

means for sensing a first signal representing an output parameter of a photodetector which signal is in response to an emission of non-exiting light by said one of said lightemitting elements; and means, responsive to said first signal, for determining malfunction of said one light-emitting element and generating a second signal representing a malfunction of said one light-emitting element.

26. The apparatus of claim 25 and including a shutter, and means for closing the shutter to block light from the light-emitting elements from exposing a photosensitive recording medium.

27. The apparatus of claim 25 in combination with a photosensitive recording medium and wherein said first signal is sensed in real-time during a recording period for recording pixels by said light-emitting elements on the photosensitive recording medium.

28. A method of monitoring operation of light-emitting elements on a monolithic device, the monolithic device including (a) a semiconductor substrate; (b) an array of plural light-emitting elements fabricated in the substrate, the elements being arranged in a row; and (c) a set of respective photodetectors fabricated in the substrate with a respective one of said photodetectors located sufficiently proximate each respective light-emitting element for sensing subsurface light of a respective element which subsurface light does not exit the device, said method comprising:

enabling each of plural ones of said light-emitting elements each with a predetermined current to emit light, a portion of which light exits the device and another portion of which light that does not exit the device (non-exiting light);

sensing signals representing output parameters by respective photodetectors on said device and associated with emission of non-exiting light by each of said ones of said light-emitting elements; and in response to said signals adjusting an operating parameter to said ones of said light-emitting elements when the sensed signals meet a criterion for adjustment.

29. The method of claim 28 and wherein the operating parameter is exposure duration for recording a pixel by each respective light-emitting element.

30. The method of claim 29 and wherein the operating parameter is amount of current provided to each respective light-emitting element for recording a pixel.

* * * * *